US009466894B2

(12) United States Patent
Wu et al.

(10) Patent No.: US 9,466,894 B2
(45) Date of Patent: Oct. 11, 2016

(54) ELECTRICAL CONNECTION TERMINAL HAVING A METAL LEAF SPRING ACTUATED BY A SHIFT MEMBER AND AN ELASTIC UNIT

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/923,766

(22) Filed: Oct. 27, 2015

(65) Prior Publication Data

US 2016/0190713 A1 Jun. 30, 2016

(30) Foreign Application Priority Data

Dec. 31, 2014 (TW) ..... 103223439 U
Aug. 10, 2015 (TW) ..... 104125877 A

(51) Int. Cl.
*H01R 13/62* (2006.01)
*H01R 4/48* (2006.01)
*H01R 13/42* (2006.01)

(52) U.S. Cl.
CPC ..... *H01R 4/4836* (2013.01); *H01R 13/42* (2013.01)

(58) Field of Classification Search
CPC .. H01R 4/4809; H01R 4/4836; H01R 13/41; H01R 13/42
USPC ..... 439/310, 345, 441, 436, 834, 835, 838
See application file for complete search history.

(56) References Cited

U.S. PATENT DOCUMENTS 6,146,187 A * 11/2000 Pallai ..... H01R 4/4836 439/431
6,827,614 B2 * 12/2004 Bechaz ..... H01R 4/4845 439/828
7,241,188 B2 * 7/2007 Lin ..... H01R 4/4863 439/838
7,287,999 B2 * 10/2007 Holterhoff ..... H01R 4/4836 439/441
8,491,327 B2 * 7/2013 Hartmann ..... H01R 31/085 439/441
8,858,269 B2 * 10/2014 Brand ..... H01R 4/4827 439/733.1
2003/0066673 A1 * 4/2003 Doutaz ..... H01R 4/4836 174/652
2013/0143427 A1 * 6/2013 Abundis ..... H01R 4/4836 439/310

FOREIGN PATENT DOCUMENTS

EP 2325947 A1 5/2011

* cited by examiner

*Primary Examiner* — Chandrika Prasad
(74) *Attorney, Agent, or Firm* — Rosenberg, Klein & Lee

(57) ABSTRACT

An electrical connection terminal structure includes: a main body defining a chamber; a metal leaf spring disposed in the chamber, the metal leaf spring being movable with the motion of a shift member to press a conductive wire into electrical connection or release the conductive wire; and an elastic unit mounted in the chamber. When the metal leaf spring is released from the pressing of the shift member to release the conductive wire from the pressing, the elastic unit normally makes the metal leaf spring and the shift member move toward a position where the conductive wire is released. This improves the shortcoming of the conventional electrical connection terminal that when released, the metal leaf spring is apt to interfere with the conductive wire and make it hard to extract the conductive wire out of the main body.

35 Claims, 8 Drawing Sheets

ELECTRICAL CONNECTION TERMINAL HAVING A METAL LEAF SPRING ACTUATED BY A SHIFT MEMBER AND AN ELASTIC UNIT

BACKGROUND OF THE INVENTION

1. Field of the Invention

The present invention relates generally to an electrical connection terminal structure, and more particularly to an electrical connection terminal structure for an electrical conductive wire to insert and connect with. The an electrical connection terminal structure includes a main body, a shift member, an elastic unit and a metal leaf spring assembled with each other. The metal leaf spring is movable with the motion of the shift member to press the conductive wire or release the conductive wire.

2. Description of the Related Art

A conventional electrical connection terminal device or wire-pressing terminal has an insulation case (generally made of plastic material). A shift member is mounted on the case to control a metal leaf spring enclosed in the case to releasably press a conductive wire inserted in the terminal device into electrical connection. For example, EP 2325947 A1 discloses typical electrical connection terminals.

The conventional electrical connection terminal is for inserting on a circuit board (such as a PCB). The conventional electrical connection terminal includes an insulation case and a shift member reciprocally movably mounted on the case. The case has a through hole or wire inlet for a conductive wire to insert into the case. The case defines a chamber in which a metal leaf spring is mounted. The shift member is operable to control the metal leaf spring into contact or electrical connection with the conductive wire inserted in the case.

To speak more specifically, the metal leaf spring has a head end. After the conductive wire is inserted into the case, the shift member can be pressed down to force the head end of the metal leaf spring to bite the conductive wire and keep the conductive wire in contact with the metal leaf spring without easy detachment from the insulation case. Only when an operator pushes the shift member upward to release the pressing state, the conductive wire is released from the pressing of the metal leaf spring.

Basically, the metal leaf spring is connected with a finer or narrower terminal pin in a symmetrical form. The terminal pin is inserted on the circuit board and electrically connected with the circuit board.

With respect to the structural design and application of such kind of electrical connection terminal, when an operator pushes the shift member upward to make the metal leaf spring release the conductive wire and allow the conductive wire to be extracted out of the case, the head end of the metal leaf spring will naturally swing down in a released state. Under such circumstance, the head end of the metal leaf spring is apt to interfere with the conductive wire and hinder the conductive wire from being extracted out of the case. As a result, the extraction of the conductive wire will be affected. Especially, when it is desired to extract a conductive wire with a larger diameter, the above problem will more often take place. Under such circumstance, an operator often needs to use an auxiliary tool to extract the conductive wire out of the case. This is not what we expect.

According to the above, the conventional electrical connection terminal including the shift member, metal leaf spring and other relevant components has some shortcomings in assembly and structural design. The assembling structures of the case, the shift member and the metal leaf spring of the conventional electrical connection terminal need to be redesigned into an improved structure, which is different from the conventional electrical connection terminal in use form and application and can be more easily and conveniently operated.

It is therefore tried by the applicant to provide an electrical connection terminal structure to overcome or improve the above problems of the conventional electrical connection terminal. The electrical connection terminal structure of the present invention can stably press the conductive wire. To speak more specifically, the electrical connection terminal structure of the present invention has the following advantages:

First, the electrical connection terminal structure includes a latch member for helping in fixing the shift member to stably press the metal leaf spring and the conductive wire. When the conductive wire is released from the pressing, the shift member is interfered with to slow down the speed by which the shift member is pushed upward. This improves the shortcoming of the conventional electrical connection terminal that when operating the shift member, the shift member is apt to collide the main body or the case to cause damage or fissure of the main body.

Second, especially, the electrical connection terminal structure includes an elastic unit for helping the metal leaf spring and the shift member to move. Accordingly, the shift member can be truly moved to a set position. In this case, an operator can easily check whether the component is damaged from the position of the shift member. This overcomes the shortcoming of the conventional electrical connection terminal that it is necessary to troublesomely disassemble the entire terminal structure to check the interior of the main body or the case.

SUMMARY OF THE INVENTION

It is therefore a primary object of the present invention to provide an electrical connection terminal structure includes: a main body defining a chamber; a metal leaf spring disposed in the chamber, the metal leaf spring being movable with the motion of a shift member to press a conductive wire into electrical connection or release the conductive wire; and an elastic unit mounted in the chamber. When the metal leaf spring is released from the pressing of the shift member to release the conductive wire from the pressing, the elastic unit normally makes the metal leaf spring and the shift member move toward a position where the conductive wire is released. This improves the shortcoming of the conventional electrical connection terminal that when released, the metal leaf spring is apt to interfere with the conductive wire and make it hard to extract the conductive wire out of the main body.

In the above electrical connection terminal structure, the elastic unit includes a fixed end and a free end. The fixed end is leant against a stop section of the main body to provide an action force or pre-torque. Accordingly, the free end normally pushes the metal leaf spring and the shift member in a direction to the position where the conductive wire is released.

In the above electrical connection terminal structure, the shift member is formed with a shoulder section. A damping section is disposed in the chamber of the main body corresponding to the shoulder section of the shift member. When the shift member is operated and pushed upward, the damping section frictionally interferes with the shoulder section to slowdown the speed by which the metal leaf spring elastically pushes the shift member. Therefore, the collision force applied by the shift member to the main body is reduced. This improves the problem of the conventional electrical connection terminal that the metal leaf spring will apply an elastic force to the shift member to make the shift member collide the main body to cause fissure or damage of the main body.

In the above electrical connection terminal structure, the main body is provided with a latch member. The shift member is formed with a cavity and a restriction section formed in the cavity corresponding to the latch member. When operating (pressing down) the shift member to make the metal leaf spring press the conductive wire inserted in the main body, the restriction section of the shift member will first push away the latch member and make the latch member enter the cavity to latch with the restriction section. Accordingly, the metal leaf spring is fixed to stably press the conductive wire.

The present invention can be best understood through the following description and accompanying drawings, wherein:

DETAILED DESCRIPTION OF THE PREFERRED EMBODIMENTS

Figure 1:
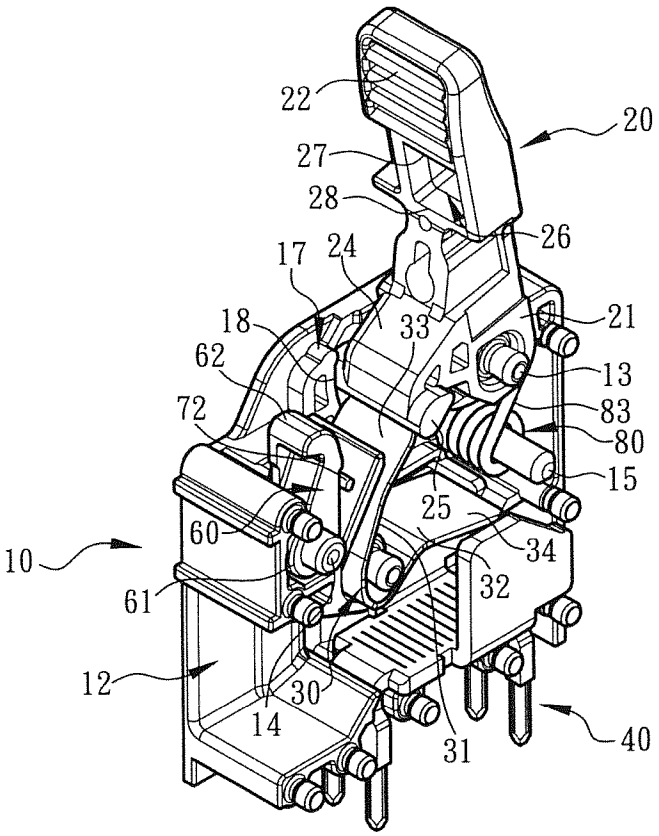
FIG. 1 is a perspective assembled view of the electrical connection terminal structure of the present invention, showing that the shift member is positioned in the opened position in cooperation with the metal leaf spring.
Figure 2:
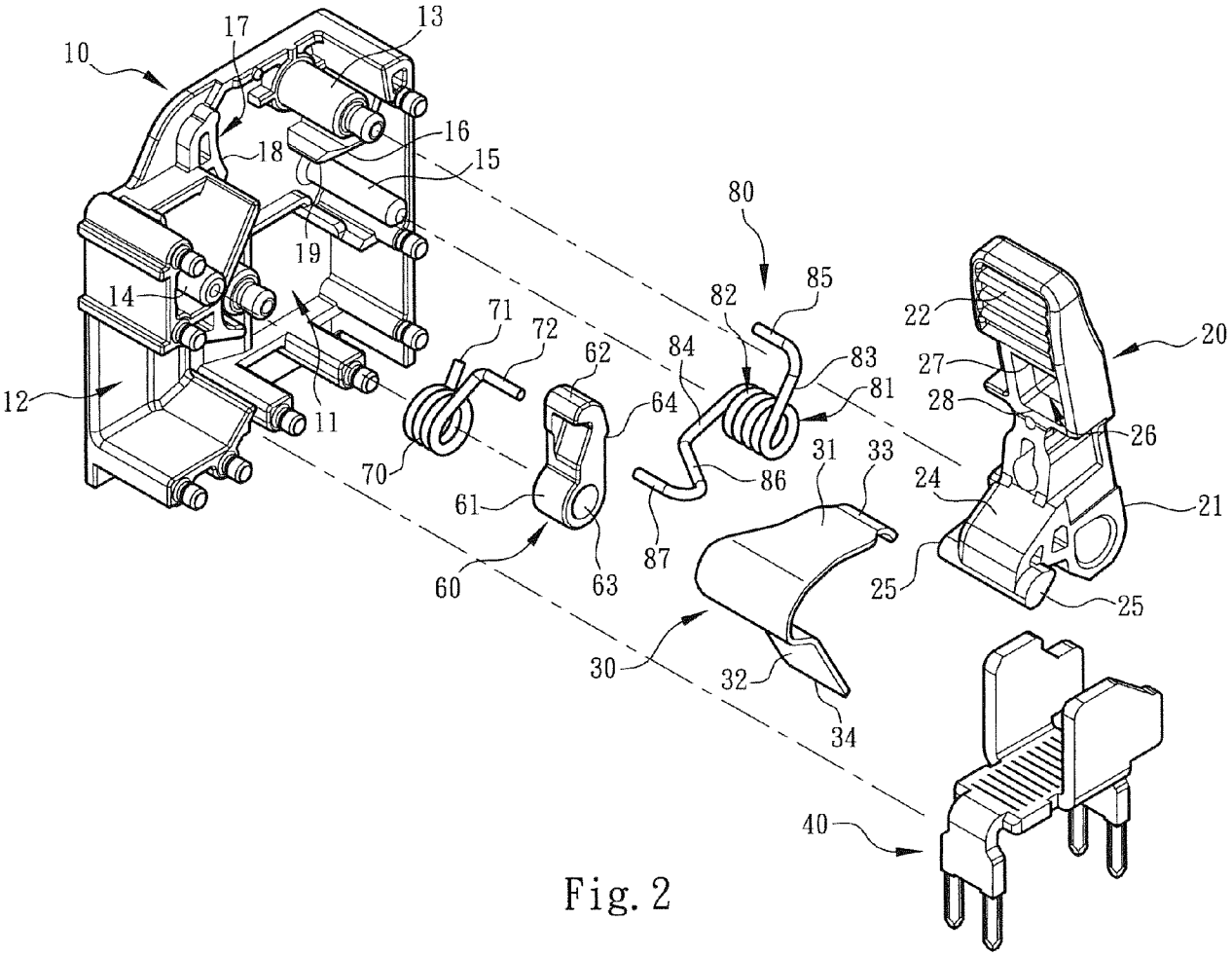
FIG. 2 is a perspective exploded view of the electrical connection terminal structure of the present invention.
Figure 3:
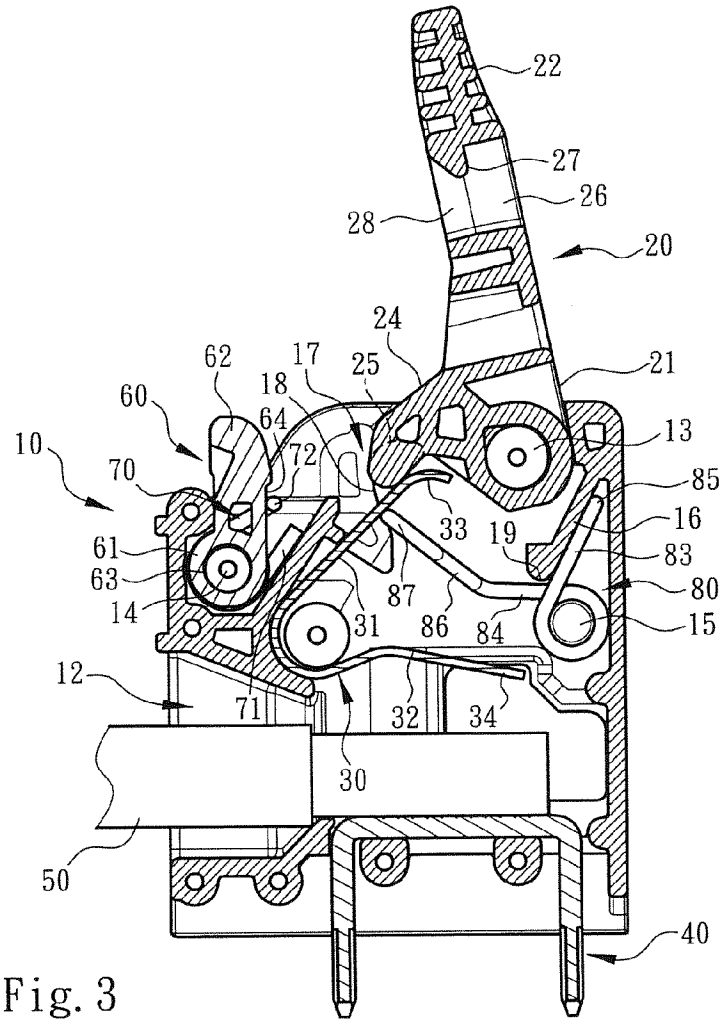
FIG. 3 is a plane sectional view of the electrical connection terminal structure of the present invention according to FIG. 1.

Please refer to FIGS. 1,2 and 3. The electrical connection terminal structure of the present invention includes a main body 10 made of insulation material and a shift member 20. The main body 10 defines a chamber 11. A metal leaf spring 30 and a terminal pin 40 are mounted in the chamber 11. The terminal pin 40 is for inserting on a circuit board (such as a PCB). The main body 10 includes a wire inlet 12 in communication with the chamber 11. A conductive wire 50 can be inserted into the chamber 11 through the wire let 12 to be pressed by the metal leaf spring 30, whereby the conductive wire 50 is electrically connected with the terminal pin 40.

In this embodiment, the metal leaf spring 30 is movable along with the motion of the shift member 20 to press the conductive wire 50 into electrical connection with the terminal pin 40 or release the conductive wire 50. To speak more specifically, the shift member 20 includes a pivoted end 21 and an operation end 22. The pivoted end 21 is pivotally connected on a pivot shaft 13 of the main body 10 or the chamber 11, whereby the operation end 22 is reciprocally movable. A press section 24 protrudes from the pivoted end 21 in the form of a cantilever for pressing the metal leaf spring 30. At least one side of the press section 24 is formed with a shoulder section 25.

As shown in the drawings, the metal leaf spring 30 has a first section 31 and a second section 32. The first section 31 includes a head end 33 and the second section 32 includes a tail end 34. The first section 31 or the head end 33 contacts the press section 24 of the shift member 20, whereby the press section 24 can press down the first section 31 or the head end 33 of the metal leaf spring 30 and make the tail end 34 press or bite the conductive wire 50 in the chamber 11. After the shift member 20 is operated and pushed upward, the conductive wire 50 is released from the press of the tail end 34. This will be further described hereinafter.

As shown in the drawings, a reciprocally movable latch member 60 is mounted in the chamber 11. The latch member 60 is assembled with a spring 70, whereby the latch member 60 is positioned in a position where the shift member 20 is latched by the latch member 60 in normal state.

In this embodiment, the shift member 20 is formed with a cavity 26 between the pivoted end 21 and the operation end 22 or near the operation end 22. A restriction section 27 is formed in the cavity 26 to define an entrance 28 of the cavity 26. The latch member 60 and the spring 70 are together mounted in the chamber 11 of the main body 10 corresponding to the cavity 26 and restriction section 27 of the shift member 20.

As shown in FIGS. 2 and 3, the latch member 60 includes a pivoted end 61 and a free end 62. The pivoted end 61 has a hole 63 and is assembled on a pivot shaft 14 in the chamber 11 of the main body 10 together with the spring 70. Accordingly, the free end 62 of the latch member 60 can reciprocally move into the cavity 26 of the shift member to latch with the restriction section 27 or be pushed away by the restriction section 27 of the shift member 20 and unlatched from the restriction section 27.

In this embodiment, the spring 70 has a first end 71 and a second end 72. The first end 71 is pressed against the main body 10. The second end 72 is formed with a perpendicularly bent section from the spring 70. The second end 72 is leant against a back section 64 of the latch member 60. Accordingly, as aforesaid, in normal state, the latch member 60 is positioned in a position where the restriction section 27 of the shift member is latched by the latch member 60.

In a preferred embodiment, the electrical connection terminal structure further includes an elastic unit 80 disposed in the chamber 11 of the main body 10. When the shift member 20 makes the conductive wire 50 released from the press of the metal leaf spring 30, the elastic unit 80 serves to normally make the shift member 20 and the metal leaf spring 30 move to a position where the conductive wire 50 is released. The elastic unit 80 is selectively a torque spring, a leaf spring or the like.

To speak more specifically, the elastic unit 80 is defined with a first side 81 and a second side 82. The first side 81 is close to the right side of FIG. 2, while the second side 82 is close to the left side of FIG. 2. The elastic unit 80 includes a fixed end 83 extending from the first side 81 and a free end 84 extending from the second side 82. The fixed end 83 has a (perpendicular) bent section 85 bent from the first side 81 to the second side 82. The free end 84 has an oblique section 86 obliquely extending from the second side 82 to the first side 81 and a bent section 87 connected with the oblique section 86. The bent section 87 is bent from the first side 81 to the second side 82.

Please further refer to FIGS. 2 and 3. The oblique section 86 of the elastic unit 80 integrally extends from the free end 84 to the first side 81 of the elastic unit 80 and the upper side of FIG. 3. The bent section 87 is further bent from the oblique section 86 and extends to the second side 82 of the elastic unit 80.

The elastic unit 80 is mounted on a post 15 in the chamber 11 of the main body. The free end 84 or the bent section 87 of the elastic unit 80 contacts lower side of the first section 31 of the metal leaf spring. The fixed end 83 or the bent section 85 of the elastic unit 80 is leant against a stop section 16 of the main body 10 to provide an action force or pre-torque. Accordingly, the free end 84 normally pushes the metal leaf spring 30 and the shift member 20 in a direction to the position where the conductive wire 50 is released.

As shown in the drawings, the stop section 16 has a guide angle 19 to facilitate the installation of the elastic unit 80 or the fixed end 81 on the main body 10 or the stop section 16.

Figure 5:
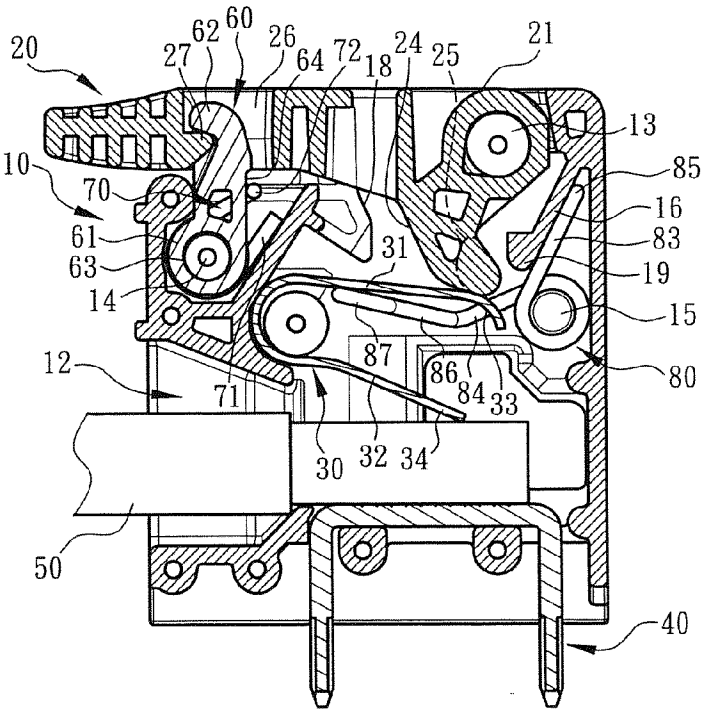
FIG. 5 is a plane sectional view of the electrical connection terminal structure of the present invention according to FIG. 4, showing that the shift member is operated to reach the latched position.
Figure 4:
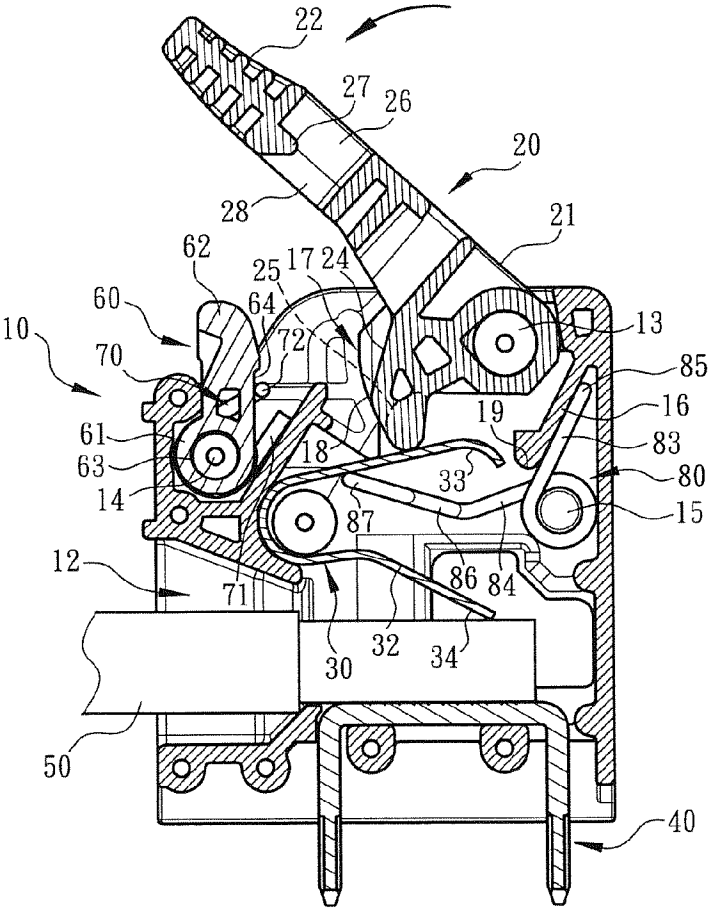
FIG. 4 is a plane sectional view of the electrical connection terminal structure of the present invention, showing that the shift member is operated and pressed down to make the metal leaf spring press the conductive wire.

Please now refer to FIGS. 3, 4 and 5. FIG. 3 shows that the free end 84 or the bent section 87 of the elastic unit 80 pushes the first section 31 of the metal leaf spring to the upper side of the drawing so as to drive the second section 32 and the tail end 34 to a position on upper side of the drawing. Under such circumstance, the conductive wire 50 can be inserted into the chamber 11 through the wire inlet 12.

When the shift member 20 is operated and pressed down to move toward a closed position as shown in FIG. 4, the press section 24 will press the first section 31 (or head end 33) of the metal leaf spring 30 and the free end 84 or bent section 87 of the elastic unit 80, whereby the tail end 34 of the metal leaf spring is swung to the lower side of the drawing to press the conductive wire 50 inserted in the main body 10 or the chamber 11. At this time, the elastic unit 80 is forced to store the elastic action force or pre-torque as aforesaid.

Referring to FIGS. 4 and 5, when the restriction section 27 of the shift member 20 reaches the position where the free end 62 of the latch member is latched with the restriction section 27, the restriction section 27 will first push away the free end 62 of the latch member 60 to make the back section 64 of the latch member 60 push/press the second end 72 of the spring, whereby the spring 70 is forced to store energy. After the restriction section 27 passes over the free end 62 of the latch member, the spring 70 will release the previously stored energy to force the free end 62 to enter the cavity 26 and move back to the position where the restriction section 27 of the shift member is latched by the free end 62. Under such circumstance, the shift member 20 and the tail end 34 of the metal leaf spring are fixed to keep pressing the conductive wire 50.

It should be noted that when a user applies an operation force to push the shift member 20 upward and make the restriction section 27 push away the free end 62 of the latch member 60 to release the latching state, the elastic unit 80 will release the previously stored action force or pre-torque to bound away the metal leaf spring 30. At this time, the first and second sections 31, 32 of the metal leaf spring 30 are pushed to the upper side of the drawing to urge the shift member 20 to automatically move toward an opened position as shown in FIG. 3. At the same time, the conductive wire 50 is released from the press of the tail end 34 of the metal leaf spring.

In operation, the action force or pre-torque released from the elastic unit 80 will push away the metal leaf spring 30 to force the tail end 34 thereof to truly leave the position where the conductive wire 50 is pressed by the tail end 34. Therefore, the conductive wire 50 is easy to extract out of the main body 10. This eliminates the problem of the conventional electrical connection terminal that when released, the metal leaf spring will naturally swing down to hinder or interfere with the conductive wire 50.

Please now refer to FIG. 5. In a preferred embodiment, a damping section 17 is disposed in the main body 10 or the chamber 11 corresponding to the shoulder section 25 of the shift member 20. The damping section 17 is formed with an arched recessed face 18. When the shift member 20 is operated and pushed upward, the damping section 17 or the arched recessed face 18 will frictionally interfere with the shoulder section 25 to slow down the speed by which the metal leaf spring 30 elastically pushes the shift member 20. Therefore, the collision force applied by the shift member 20 to the main body 10 is reduced. This improves the problem of the conventional electrical connection terminal that the metal leaf spring will apply an elastic force to the shift member to make the shift member collide the main body to cause fissure or damage of the main body.

It should be noted that the shoulder section 25 has an arched configuration in adaptation to the arched recessed face 18. In this case, the shoulder section 25 (or the press section 24) of the shift member 20 can more gently and smoothly move relative to the arched recessed face 18 (or the damping section 17) of the main body 10.

Figure 6:
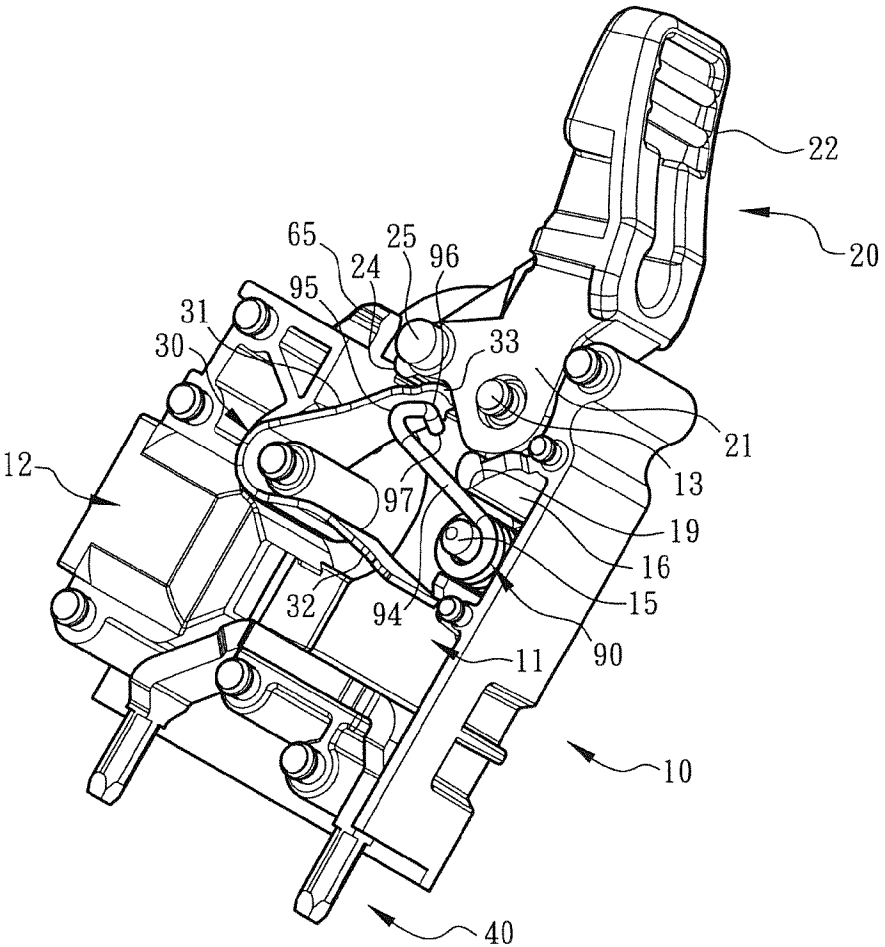
FIG. 6 is a perspective assembled view of a modified embodiment of the electrical connection terminal structure of the present invention, showing that the shift member is positioned in the opened position in cooperation with the metal leaf spring.
Figure 7:
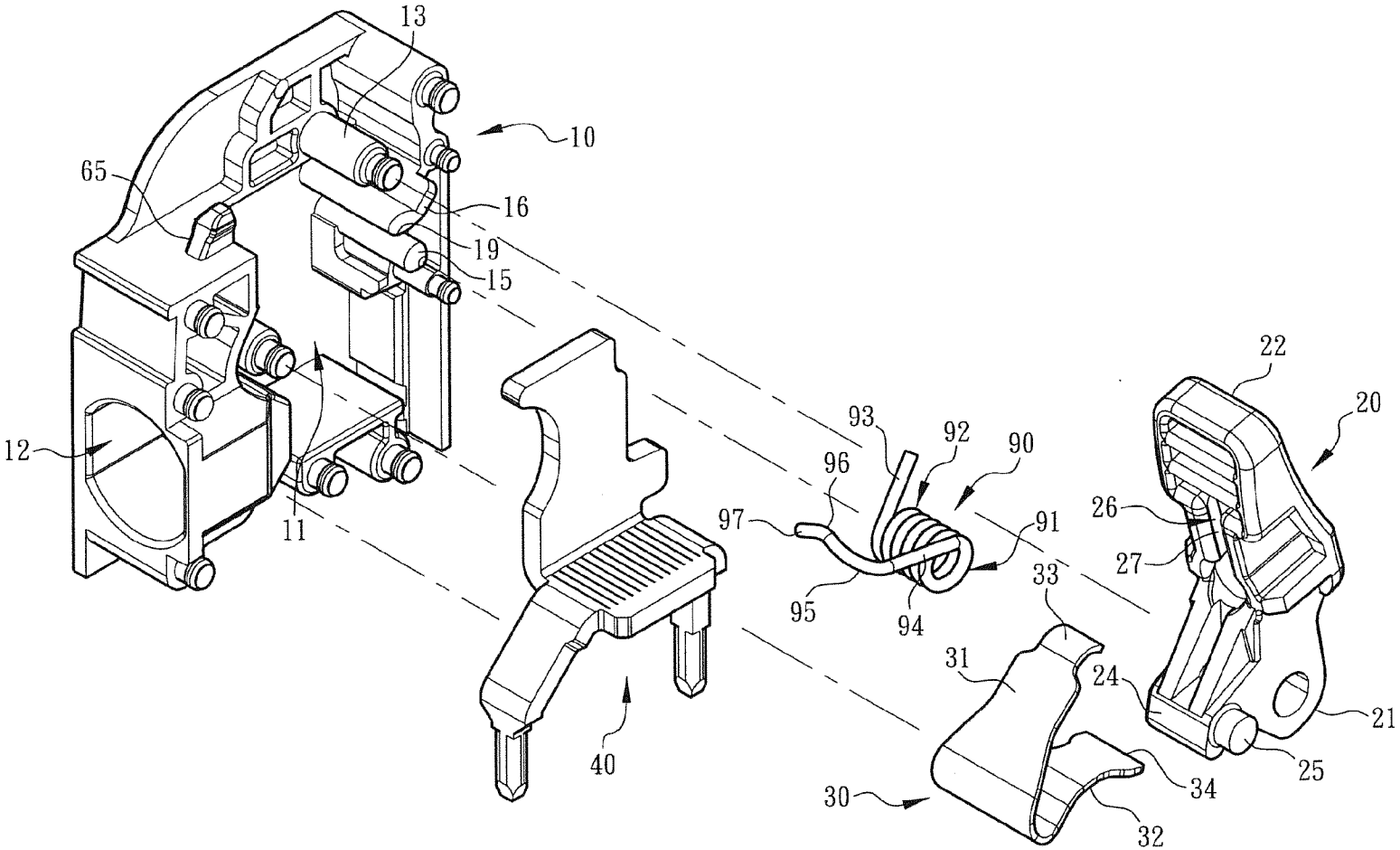
FIG. 7 is a perspective exploded view according to FIG. 6.
Figure 8:
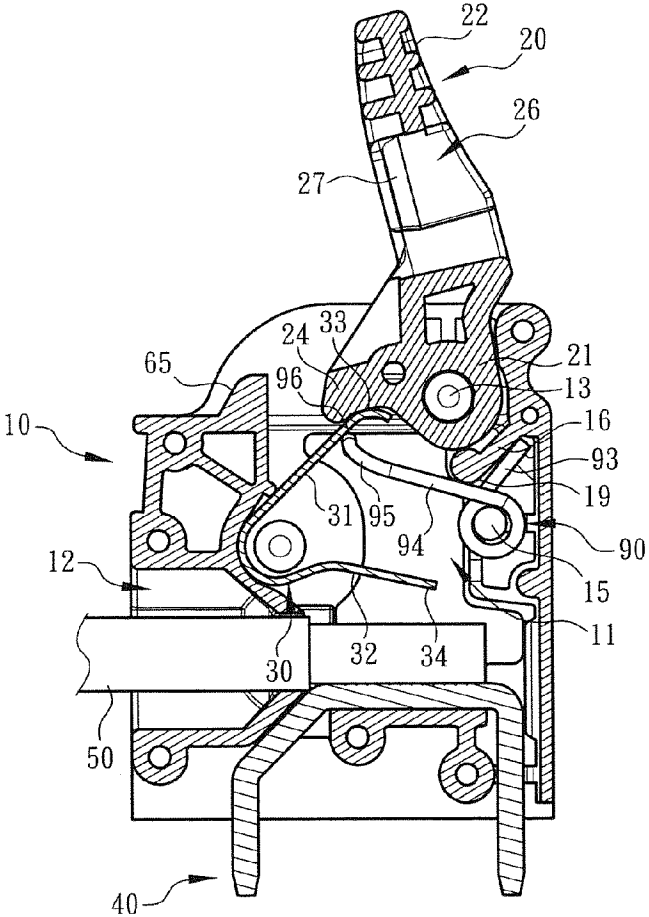
FIG. 8 is a plane sectional view according to FIG. 6.

Please refer to FIGS. 6, 7 and 8. In a modified embodiment of the present invention, the elastic unit 80 has a simplified structure or configuration to facilitate manufacturing and control of quality/specification of the product and thus lower the cost for the material, manufacturing and assembly. According to this embodiment, the electrical connection terminal structure of the present invention includes a main body 10 made of insulation material and a shift member 20. The main body 10 defines a chamber 11. A metal leaf spring 30 and a terminal pin 40 are mounted in the chamber 11. The terminal pin 40 is for inserting on a circuit board (such as a PCB). The main body 10 includes a wire inlet 12 in communication with the chamber 11. A conductive wire 50 can be inserted into the chamber 11 through the wire let 12 to be pressed by the metal leaf spring 30, whereby the conductive wire 50 is electrically connected with the terminal pin 40.

In this embodiment, the metal leaf spring 30 is movable along with the motion of the shift member 20 to press the conductive wire 50 into electrical connection with the terminal pin 40 or release the conductive wire 50. To speak more specifically, the shift member 20 includes a pivoted end 21 and an operation end 22. The pivoted end 21 is pivotally connected on a pivot shaft 13 of the main body 10 or the chamber 11, whereby the operation end 22 is reciprocally movable. A press section 24 protrudes from the pivoted end 21 in the form of a cantilever for pressing the metal leaf spring 30. At least one side of the press section 24 is formed with a shoulder section 25.

As shown in the drawings, the metal leaf spring 30 has a first section 31 and a second section 32. The first section 31 includes a head end 33 and the second section 32 includes a tail end 34. The first section 31 or the head end 33 contacts the press section 24 of the shift member 20, whereby the press section 24 can press down the first section 31 or the head end 33 of the metal leaf spring 30 and make the tail end 34 press or bite the conductive wire 50 in the chamber 11. After the shift member 20 is operated and pushed upward, the conductive wire 50 is released from the press of the tail end 34. This will be further described hereinafter.

As shown in the drawings, a latch section 65 is disposed on the main body 10. The shift member 20 is formed with a cavity 26 between the pivoted end 21 and the operation end 22 or near the operation end 22. A restriction section 27 is formed in the cavity 26 corresponding to the latch section 65. When the shift member 20 is operated and pressed down, the restriction section 27 will interfere with the latch section 65 and latch with the latch section 65 to keep the shift member 20 positioned in a latched position or latched state. The shift member 20 can be released and unlatched only when an operator pushes the shift member 20 upward.

As shown in FIGS. 6, 7 and 8, the electrical connection terminal structure further includes an elastic unit 90 disposed in the chamber 11 of the main body 10. When the shift member 20 makes the conductive wire 50 released from the press of the metal leaf spring 30, the elastic unit 90 serves to normally make the shift member 20 and the metal leaf spring 30 move to a position where the conductive wire 50 is released. The elastic unit 90 is selectively a torque spring, a leaf spring or the like.

To speak more specifically, the elastic unit 90 is defined with a first side 91 and a second side 92. The first side 91 is close to the right side of FIG. 7, while the second side 92 is close to the left side of FIG. 7. The elastic unit 90 includes a free end 94 extending from the first side 91 and a fixed end 93 extending from the second side 92. The fixed end 94 includes an (arched) bent section 95 bent and extending from the first side 91 to the second side 92, and a curved section 96 connected with the bent section 95.

Please refer to FIG. 8. The bent section 95 integrally extends from the free end 94 to the upper side of FIG. 8 and then is bent to the second side 92 of the elastic unit 90. The curved section 96 extends to the second side 92 and is further bent from the upper side of FIG. 7 or FIG. 8 to the lower side of FIG. 7 or FIG. 8 to form a tail section 97 connected with the curved section 96.

Therefore, when seen from FIG. 7 or FIG. 8, the position of the curved section 96 is higher than the position of the bent section 95 or the free end 94, whereby the curved section 96 can at least contact the first section 31 or the head end 33 of the metal leaf spring.

As shown in the drawings, the stop section 16 has a guide angle 19 to facilitate the installation of the elastic unit 90 or the fixed end 93 on the main body 10 or the stop section 16.

Figure 9:
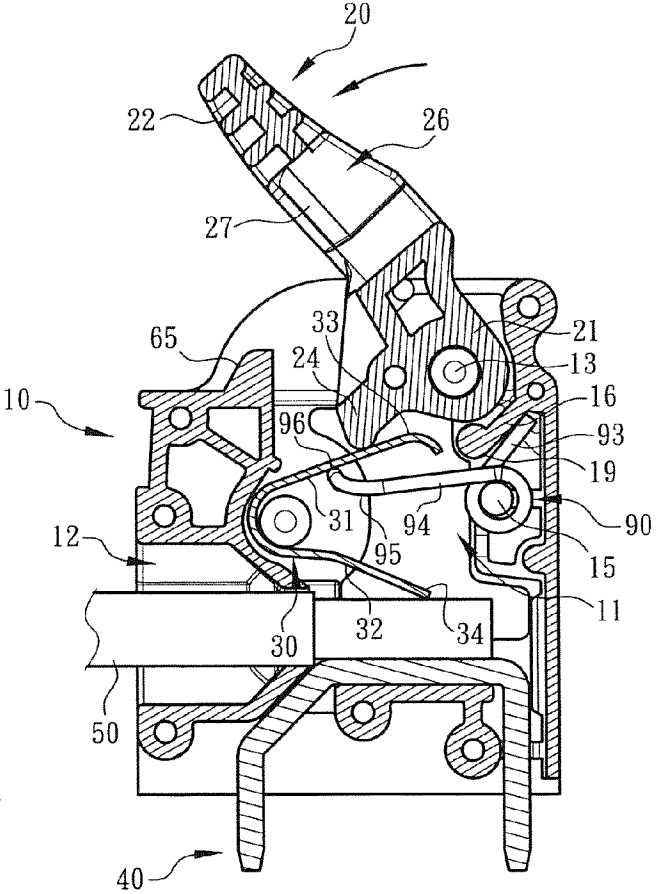
FIG. 9 is a plane sectional view of the electrical connection terminal structure of the present invention according to FIG. 6, showing that the shift member is operated and pressed down to make the metal leaf spring press the conductive wire and the elastic unit cooperates with the shift member.
Figure 10:
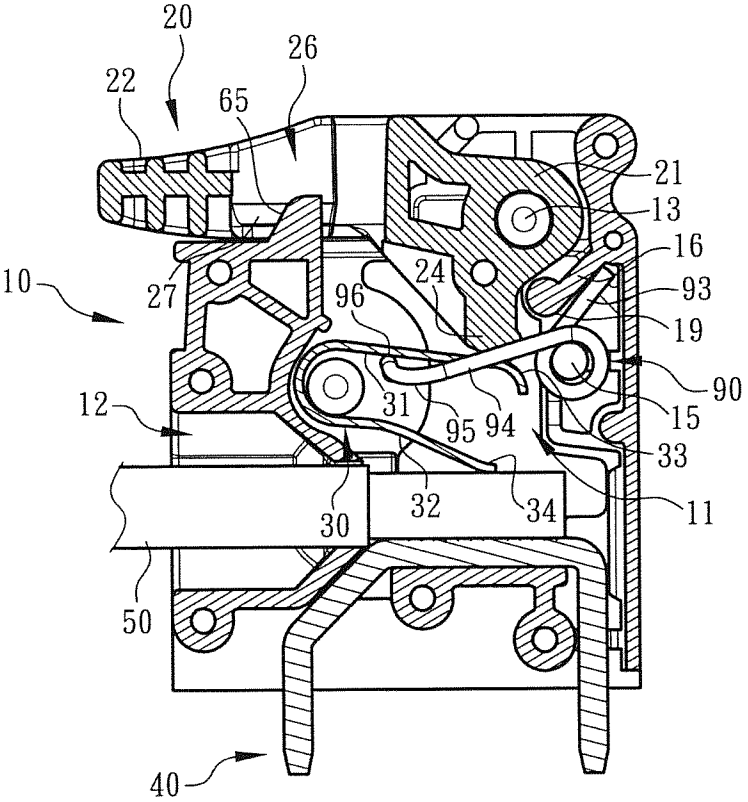
FIG. 10 is a plane sectional view of the electrical connection terminal structure of the present invention according to FIG. 6, showing that the shift member is positioned in the latched position to make the metal leaf spring press the conductive wire and the elastic unit cooperates with the shift member.

Please now refer to FIGS. 8, 9 and 10. FIG. 8 shows that the shift member 20 is positioned in the opened position and the curved section 96 of the free end 94 of the elastic unit pushes the first section 31 of the metal leaf spring to the upper side of the drawing so as to drive the second section 32 and the tail end 34 to a position on upper side of the drawing. Under such circumstance, the conductive wire 50 can be inserted into the chamber 11 through the wire inlet 12.

When the shift member 20 is operated and pressed down to move toward the closed position as shown in FIG. 9, the press section 24 will press the first section 31 (or head end 33) of the metal leaf spring 30 and the curved section 96 of the elastic unit 90, whereby the tail end 34 of the metal leaf spring is swung to the lower side of the drawing to press the conductive wire 50 inserted in the main body 10 or the chamber 11. At this time, the elastic unit 90 is forced to store the elastic action force or pre-torque.

FIG. 10 shows that the shift member 20 is positioned in the latched position. When the restriction section 27 of the shift member 20 reaches the position of the latch section 65, the restriction section 27 interferes with and latches with the latch section 65. Under such circumstance, the shift member 20 and the tail end 34 of the metal leaf spring are fixed to keep pressing the conductive wire 50.

It should be noted that when a user applies an operation force to push the shift member 20 upward and release the restriction section 27 from the latching of the latch section 65, the elastic unit 90 will release the previously stored action force or pre-torque to bound away the metal leaf spring 30. At this time, the first and second sections 31, 32 of the metal leaf spring 30 are pushed to the upper side of the drawing to urge the shift member 20 to automatically move toward the opened position as shown in FIG. 8. At the same time, the conductive wire 50 is released from the press of the tail end 34 of the metal leaf spring.

In operation, the action force or pre-torque released from the elastic unit 80 will push away the metal leaf spring 30 to force the tail end 34 thereof to truly leave the position where the conductive wire 50 is pressed by the tail end 34. Therefore, the conductive wire 50 is easy to extract out of the main body 10. This eliminates the problem of the conventional electrical connection terminal that when released, the metal leaf spring will naturally swing down to hinder or interfere with the conductive wire 50.

It should be noted that in comparison with the elastic unit 80 of the first embodiment, the elastic unit 90 of the modified embodiment is different from the elastic unit 80 in that:

First, the fixed end 83 of the elastic unit 80 is positioned in a position on the first side 81 distal from the positions of the main body 10 and the stop section 16 as shown in FIG. 2. The fixed end 93 of the elastic unit 90 is positioned in a position on the second side 92 closer to the positions of the main body 10 and the stop section 16 as shown in FIG. 7. This helps in reducing the width or height of the stop section 16 to provide greater fixing/supporting force for the elastic unit 90.

Figure 11:
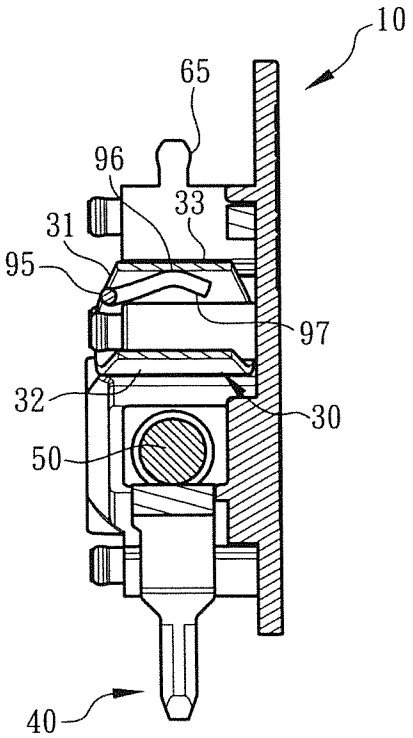
FIG. 11 is a plane sectional view of the electrical connection terminal structure of the present invention according to FIG. 9, showing that the elastic unit cooperates with the shift member to make the metal leaf spring press the conductive wire.

Second, the bent section 87 of the free end of the elastic unit 80 contacts the first section 31 of the metal leaf spring in a "linear" form. Please refer to FIG. 11. The curved section 96 of the elastic unit 90 of the modified embodiment contacts the first section 31 of the metal leaf spring in a substantially "point" form. In this case, the frictional force between the elastic unit 90 and the metal leaf spring 30 is lowered. This helps in smoothening the motion or cooperation between the elastic unit 90 and the metal leaf spring 30.

According to the above, the electrical connection terminal structure of the present invention can be optimally and stably operated. In comparison with the conventional electrical connection terminal, the electrical connection terminal structure of the present invention has the following advantages:

1. The electrical connection terminal structure and the relevant connection components of the present invention have been redesigned in use, structure design and connection relationship to be different from the conventional electrical connection terminal. For example, the shift member 20 has a press section 24 in the form of a cantilever and a shoulder section 25 in adaptation to the damping section 17 of the main body. The shift member 20 is formed with a cavity 26 and a restriction section 27 latched with the latch section 65 or the free end 62 of the latch member 60 assembled with the spring 70, whereby the latch member 60 is normally positioned in a latched position. The shift member 20 and the metal leaf spring 30 are connected with the elastic unit 80 (or 90). The elastic unit 80 (or 90) has a fixed end 83 (or 93) assembled with the stop section 16 of the main body 10 to create an action force or pre-torque, whereby the free end 84 (or the curved section 96) can push away the metal leaf spring 30 and the shift member 20. The use form of the electrical connection terminal is also changed and the application range of the electrical connection terminal is widened. In the condition that the entire structure is stabilized and is able to latch and press the conductive wire 50, the electrical connection terminal structure of the present invention can be more easily operated than the conventional electrical connection terminal structure.
2. After a use pushes the shift member 20 upward, the elastic unit 80 (or 90) provides an elastic action force to push away the metal leaf spring 30, whereby the metal leaf spring 30 will truly leave the position where the conductive wire 50 is pressed. Accordingly, obviously, a user is enabled to easily extract the conductive wire 50 out of the main body. This eliminates the problem of the conventional electrical connection terminal that when released, the metal leaf spring is apt to interfere with or hinder the conductive wire 50 from being extracted, (especially a conductive wire with larger diameter). Therefore, the operation of the electrical connection terminal structure is simplified. Moreover, it is necessary for an operator to use an auxiliary tool to operate the conventional electrical connection terminal. In contrast, the electrical connection terminal structure of the present invention can be more easily operated without using any auxiliary tool.
3. The elastic unit 80 (or 90) provides an action force to drive the shift member 20 to automatically reach the opened position or set position. Therefore, the operation strength is saved. Also, the elastic unit 80 (or 90) can make the shift member 20 truly reach the set position. In this case, an operator can easily check whether the component is damaged from the exterior of the main body 10 or the position of the shift member 20. This overcomes the shortcoming of the conventional electrical connection terminal that it is necessary to troublesomely disassemble the entire terminal structure to check the interior of the main body. That is, in case the action force of the elastic unit 80 (or 90) fails to drive the shift member 20 to reach its true position, this means the shift member 20 or some other components may be damaged or fissured. At this time, the operator can immediately repair or replace the components.
4. The main body 10 has a damping section 17 formed with an arched recessed face 18 to cooperatively frictionally interfere with the shoulder section 25 of the shift member 20 and thus control the motional speed of the shift member 20. This improves the shortcoming of the conventional electrical connection terminal that when operating the shift member, the shift member is apt to collide the main body to cause fissure or damage of the main body.

In conclusion, the electrical connection terminal structure of the present invention is effective and different from the conventional electrical connection terminal in space form. The electrical connection terminal structure of the present invention is advantageous over the conventional electrical connection terminal and inventive.

The above embodiments are only used to illustrate the present invention, not intended to limit the scope thereof. Many modifications of the above embodiments can be made without departing from the spirit of the present invention.

What is claimed is:

1. An electrical connection terminal structure comprising:

a main body defining a chamber, the main body having a wire inlet in communication with the chamber;

a shift member having a pivoted end pivotally connected with the main body and an operation end, the shift member being reciprocally movable between an opened position and a closed position, the shift member further having a press section;

a metal leaf spring disposed in the chamber, the metal leaf spring having a first section and a second section, the first section having a head end, the second section having a tail end, the first section being in contact with the press section of the shift member, whereby the press section can press and move the first section of the metal leaf spring; and an elastic unit mounted in the chamber, the elastic unit having a fixed end and a free end, the fixed end being fixedly mounted on the main body, when the metal leaf spring is released from the pressing of the press section of the shift member, the free end normally making the shift member and the metal leaf spring move toward the opened position.

2. The electrical connection terminal structure as claimed in claim 1, wherein the elastic unit is defined with a first side and a second side, the elastic unit having a fixed end extending from the first side, a bent section being connected with the fixed end and extending from the fixed end, the elastic unit having a free end extending from the second side, the free end having an oblique section and a bent section connected with the oblique section, the elastic unit being mounted on a post in the chamber of the main body, the bent section of the free end being in contact with a lower side of the first section of the metal leaf spring, the fixed end of the elastic unit being leant against a stop section of the main body.

3. The electrical connection terminal structure as claimed in claim 2, wherein the oblique section of the elastic unit integrally extends from the free end to the first side of the elastic unit and an upper side, the bent section of the free end being bent from the oblique section and extending from the oblique section to the second side of the elastic unit, the bent section of the fixed end of the elastic unit being bent from the first side to the second side, the stop section having a guide angle.

4. The electrical connection terminal structure as claimed in claim 1, wherein the elastic unit is defined with a first side and a second side, the elastic unit having a free end extending from the first side, the free end including a bent section and a curved section connected with the bent section, the elastic unit further having a fixed end extending from the second side, the elastic unit being mounted on a post in the chamber of the main body, the curved section of the free end being in contact with a lower side of the first section of the metal leaf spring, the fixed end of the elastic unit being leant against a stop section of the main body.

5. The electrical connection terminal structure as claimed in claim 4, wherein the bent section of the free end of the elastic unit is an arched structure, the bent section of the free end integrally extending from the first side of the elastic unit to an upper side and then being bent and extending to the second side of the elastic unit, the curved section being bent and extending to the second side and a lower side to form a tail section connected with the curved section.

6. The electrical connection terminal structure as claimed in claim 1, wherein the press section of the shift member is a cantilever structure protruding from the pivoted end, a terminal pin being mounted in the chamber, the terminal pin being for inserting on a circuit board, the wire inlet of the main body being for a conductive wire to be inserted into the chamber and pressed by the tail end of the metal leaf spring to electrically connect with the terminal pin.

7. The electrical connection terminal structure as claimed in claim 2, wherein the press section of the shift member is a cantilever structure protruding from the pivoted end, a terminal pin being mounted in the chamber, the terminal pin being for inserting on a circuit board, the wire inlet of the main body being for a conductive wire to be inserted into the chamber and pressed by the tail end of the metal leaf spring to electrically connect with the terminal pin.

8. The electrical connection terminal structure as claimed in claim 3, wherein the press section of the shift member is a cantilever structure protruding from the pivoted end, a terminal pin being mounted in the chamber, the terminal pin being for inserting on a circuit board, the wire inlet of the main body being for a conductive wire to be inserted into the chamber and pressed by the tail end of the metal leaf spring to electrically connect with the terminal pin.

9. The electrical connection terminal structure as claimed in claim 4, wherein the press section of the shift member is a cantilever structure protruding from the pivoted end, a terminal pin being mounted in the chamber, the terminal pin being for inserting on a circuit board, the wire inlet of the main body being for a conductive wire to be inserted into the chamber and pressed by the tail end of the metal leaf spring to electrically connect with the terminal pin.

10. The electrical connection terminal structure as claimed in claim 5, wherein the press section of the shift member is a cantilever structure protruding from the pivoted end, a terminal pin being mounted in the chamber, the terminal pin being for inserting on a circuit board, the wire inlet of the main body being for a conductive wire to be inserted into the chamber and pressed by the tail end of the metal leaf spring to electrically connect with the terminal pin.

11. The electrical connection terminal structure as claimed in claim 1, wherein at least one side of the press section of the shift member is formed with a shoulder section having an arched configuration, a damping section being disposed in the main body corresponding to the shoulder section of the shift member, the damping section being formed with an arched recessed face, whereby when the shift member is moved to the opened position, the damping section interferes with the shoulder section.

12. The electrical connection terminal structure as claimed in claim 2, wherein at least one side of the press section of the shift member is formed with a shoulder section having an arched configuration, a damping section being disposed in the main body corresponding to the shoulder section of the shift member, the damping section being formed with an arched recessed face, whereby when the shift member is moved to the opened position, the damping section interferes with the shoulder section.

13. The electrical connection terminal structure as claimed in claim 3, wherein at least one side of the press section of the shift member is formed with a shoulder section having an arched configuration, a damping section being disposed in the main body corresponding to the shoulder section of the shift member, the damping section being formed with an arched recessed face, whereby when the shift member is moved to the opened position, the damping section interferes with the shoulder section.

14. The electrical connection terminal structure as claimed in claim 4, wherein at least one side of the press section of the shift member is formed with a shoulder section having an arched configuration.

15. The electrical connection terminal structure as claimed in claim 5, wherein at least one side of the press section of the shift member is formed with a shoulder section having an arched configuration.

16. The electrical connection terminal structure as claimed in claim 1, wherein the shift member is formed with a cavity between the pivoted end and the operation end, a restriction section being formed in the cavity to define an entrance of the cavity, a reciprocally movable latch member being mounted in the cavity, the latch member being assembled with a spring, the latch member being normally positioned in a position where the shift member is latched by the latch member, the latch member including a pivoted end and a free end, the pivoted end having a hole and being assembled on a pivot shaft in the chamber of the main body together with the spring, whereby the free end of the latch member can reciprocally move into the cavity of the shift member to latch with the restriction section, the restriction section of the shift member being able to push away the free end of the latch member to unlatch from the latch member.

17. The electrical connection terminal structure as claimed in claim 2, wherein the shift member is formed with a cavity between the pivoted end and the operation end, a restriction section being formed in the cavity to define an entrance of the cavity, a reciprocally movable latch member being mounted in the cavity, the latch member being assembled with a spring, the latch member being normally positioned in a position where the shift member is latched by the latch member, the latch member including a pivoted end and a free end, the pivoted end having a hole and being assembled on a pivot shaft in the chamber of the main body together with the spring, whereby the free end of the latch member can reciprocally move into the cavity of the shift member to latch with the restriction section, the restriction section of the shift member being able to push away the free end of the latch member to unlatch from the latch member.

18. The electrical connection terminal structure as claimed in claim 3, wherein the shift member is formed with a cavity between the pivoted end and the operation end, a restriction section being formed in the cavity to define an entrance of the cavity, a reciprocally movable latch member being mounted in the cavity, the latch member being assembled with a spring, the latch member being normally positioned in a position where the shift member is latched by the latch member, the latch member including a pivoted end and a free end, the pivoted end having a hole and being assembled on a pivot shaft in the chamber of the main body together with the spring, whereby the free end of the latch member can reciprocally move into the cavity of the shift member to latch with the restriction section, the restriction section of the shift member being able to push away the free end of the latch member to unlatch from the latch member.

19. The electrical connection terminal structure as claimed in claim 4, wherein the shift member is formed with a cavity between the pivoted end and the operation end, a restriction section being formed in the cavity, a latch section being disposed on the main body for interfering and latching with the restriction section.

20. The electrical connection terminal structure as claimed in claim 5, wherein the shift member is formed with a cavity between the pivoted end and the operation end, a restriction section being formed in the cavity, a latch section being disposed on the main body for interfering and latching with the restriction section.

21. The electrical connection terminal structure as claimed in claim 11, wherein the shift member is formed with a cavity between the pivoted end and the operation end, a restriction section being formed in the cavity to define an entrance of the cavity, a reciprocally movable latch member being mounted in the cavity, the latch member being assembled with a spring, the latch member being normally positioned in a position where the shift member is latched by the latch member, the latch member including a pivoted end and a free end, the pivoted end having a hole and being assembled on a pivot shaft in the chamber of the main body together with the spring, whereby the free end of the latch member can reciprocally move into the cavity of the shift member to latch with the restriction section, the restriction section of the shift member being able to push away the free end of the latch member to unlatch from the latch member.

22. The electrical connection terminal structure as claimed in claim 12, wherein the shift member is formed with a cavity between the pivoted end and the operation end, a restriction section being formed in the cavity to define an entrance of the cavity, a reciprocally movable latch member being mounted in the cavity, the latch member being assembled with a spring, the latch member being normally positioned in a position where the shift member is latched by the latch member, the latch member including a pivoted end and a free end, the pivoted end having a hole and being assembled on a pivot shaft in the chamber of the main body together with the spring, whereby the free end of the latch member can reciprocally move into the cavity of the shift member to latch with the restriction section, the restriction section of the shift member being able to push away the free end of the latch member to unlatch from the latch member.

23. The electrical connection terminal structure as claimed in claim 13, wherein the shift member is formed with a cavity between the pivoted end and the operation end, a restriction section being formed in the cavity to define an entrance of the cavity, a reciprocally movable latch member being mounted in the cavity, the latch member being assembled with a spring, the latch member being normally positioned in a position where the shift member is latched by the latch member, the latch member including a pivoted end and a free end, the pivoted end having a hole and being assembled on a pivot shaft in the chamber of the main body together with the spring, whereby the free end of the latch member can reciprocally move into the cavity of the shift member to latch with the restriction section, the restriction section of the shift member being able to push away the free end of the latch member to unlatch from the latch member.

24. The electrical connection terminal structure as claimed in claim 14, wherein the shift member is formed with a cavity between the pivoted end and the operation end, a restriction section being formed in the cavity, a latch section being disposed on the main body for interfering and latching with the restriction section.

25. The electrical connection terminal structure as claimed in claim 15, wherein the shift member is formed with a cavity between the pivoted end and the operation end, a restriction section being formed in the cavity, a latch section being disposed on the main body for interfering and latching with the restriction section.

26. The electrical connection terminal structure as claimed in claim 16, wherein the spring has a first end and a second end, the first end being pressed against the main body, the second end being formed with a bent section from the spring, the second end being leant against a back section of the latch member.

27. The electrical connection terminal structure as claimed in claim 17, wherein the spring has a first end and a second end, the first end being pressed against the main body, the second end being formed with a bent section from the spring, the second end being leant against a back section of the latch member.

28. The electrical connection terminal structure as claimed in claim 18, wherein the spring has a first end and a second end, the first end being pressed against the main body, the second end being formed with a bent section from the spring, the second end being leant against a back section of the latch member.

29. The electrical connection terminal structure as claimed in claim 21, wherein the spring has a first end and a second end, the first end being pressed against the main body, the second end being formed with a bent section from the spring, the second end being leant against a back section of the latch member.

30. The electrical connection terminal structure as claimed in claim 22, wherein the spring has a first end and a second end, the first end being pressed against the main body, the second end being formed with a bent section from the spring, the second end being leant against a back section of the latch member.

31. The electrical connection terminal structure as claimed in claim 23, wherein the spring has a first end and a second end, the first end being pressed against the main body, the second end being formed with a bent section from the spring, the second end being leant against a back section of the latch member.

32. The electrical connection terminal structure as claimed in claim 4, wherein the position of the curved section is higher than the position of the bent section of the free end.

33. The electrical connection terminal structure as claimed in claim 5, wherein the position of the curved section is higher than the position of the bent section of the free end.

34. The electrical connection terminal structure as claimed in claim 19, wherein the position of the curved section is higher than the position of the bent section of the free end.

35. The electrical connection terminal structure as claimed in claim 20, wherein the position of the curved section is higher than the position of the bent section of the free end.

* * * * *